US005680911A

United States Patent [19]

Wang

[11] Patent Number: 5,680,911

[45] Date of Patent: Oct. 28, 1997

[54] ELECTOR EMERGENCY DEVICE

[76] Inventor: chiou nan Wang, No. 50, Alley 97, Lane 354, Sanner Road, Fengyuan City, Taichung County, Taiwan

[21] Appl. No.: 611,263

[22] Filed: Mar. 5, 1996

[51] Int. Cl.[6] ..... B66B 11/08

[52] U.S. Cl. ..... 187/263; 187/350

[58] Field of Search ..... 187/263, 266, 187/250, 350

[56] References Cited

U.S. PATENT DOCUMENTS 4,592,450 6/1986 Schaffer ..... 187/263

*Primary Examiner*—Kenneth Noland
*Attorney, Agent, or Firm*—Pro-Techtor International

[57] ABSTRACT

An elevator emergency device comprises a motor transmission spindle brake provided with an action rod having horizontally a application rod capable of swinging and having a pull cable fastened thereto, said application rod provided at a midsegment thereof with a rotary wheel having an action cable woung thereon such that one end of said action cable is fastened with an idle wheel. When the pull cable is pulled, the application rod is activated to cause the rotation of the action wheel as well as the disengagement of the brake shoe with the motor transmission spindle, thereby bringing about the operation of the elevator cab lifting and descending cable. The transmission wheel and the rotary wheel are provided with a speed-limiting friction wheel for regulating the rotational speed of the action wheel so as to prevent the elevator cab lifting and descending cable from moving the elevator cab too rapidly.

2 Claims, 5 Drawing Sheets

FIG, 1

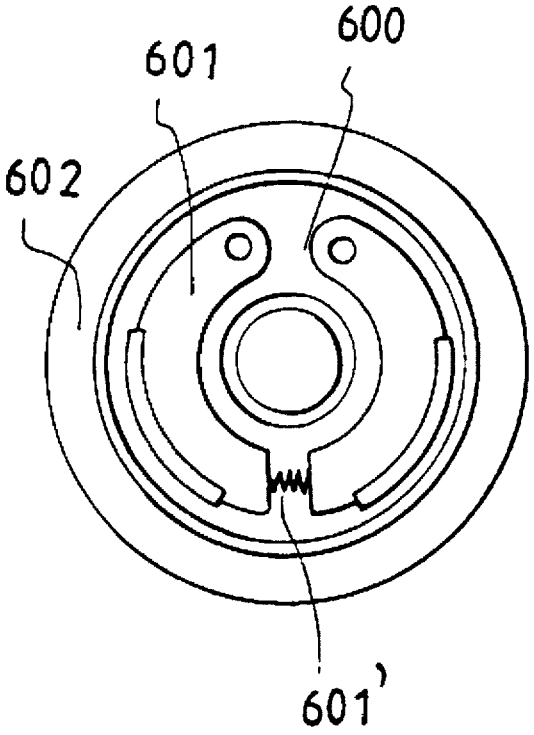
FIG, 3

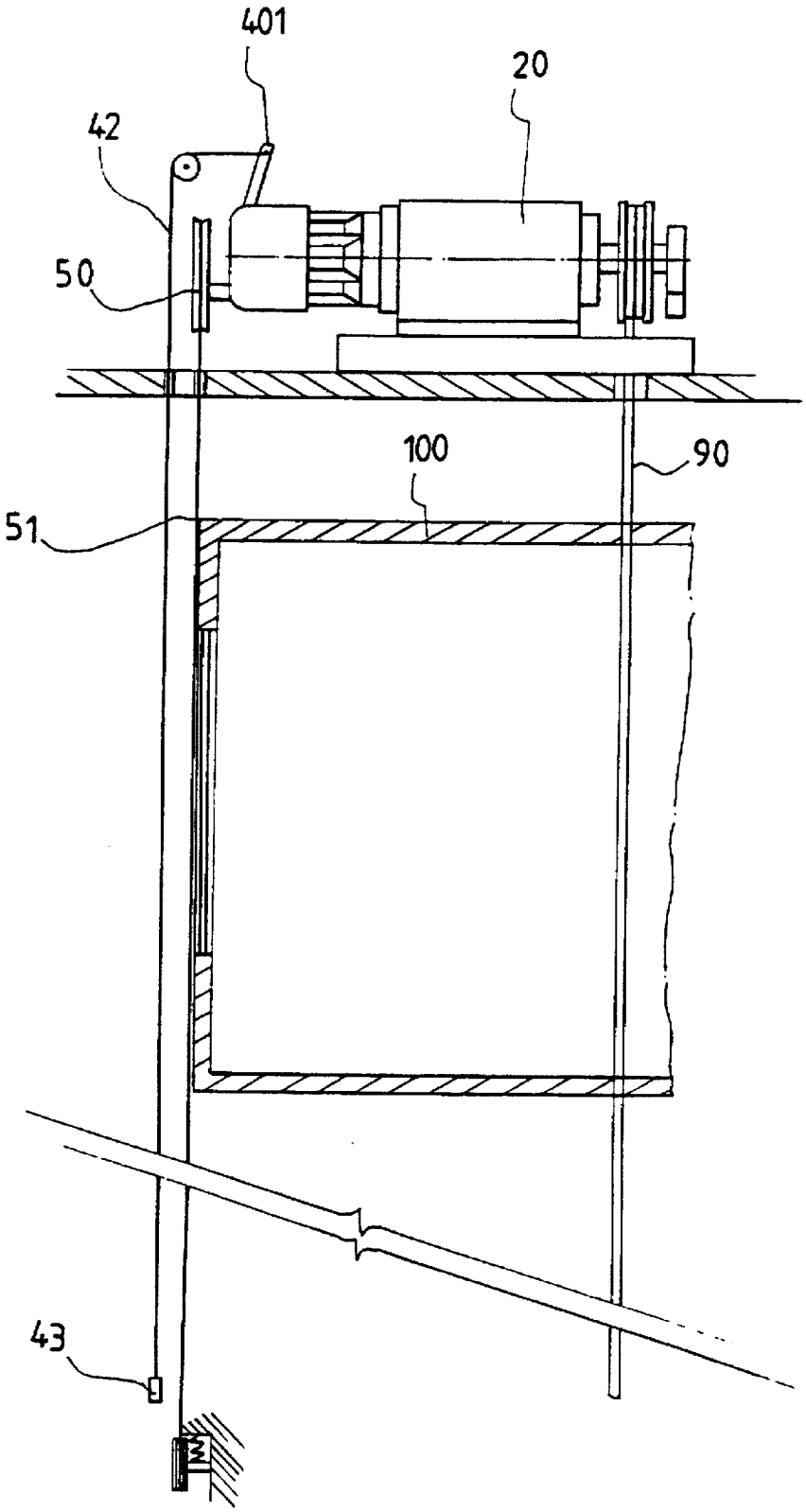
FIG, 4

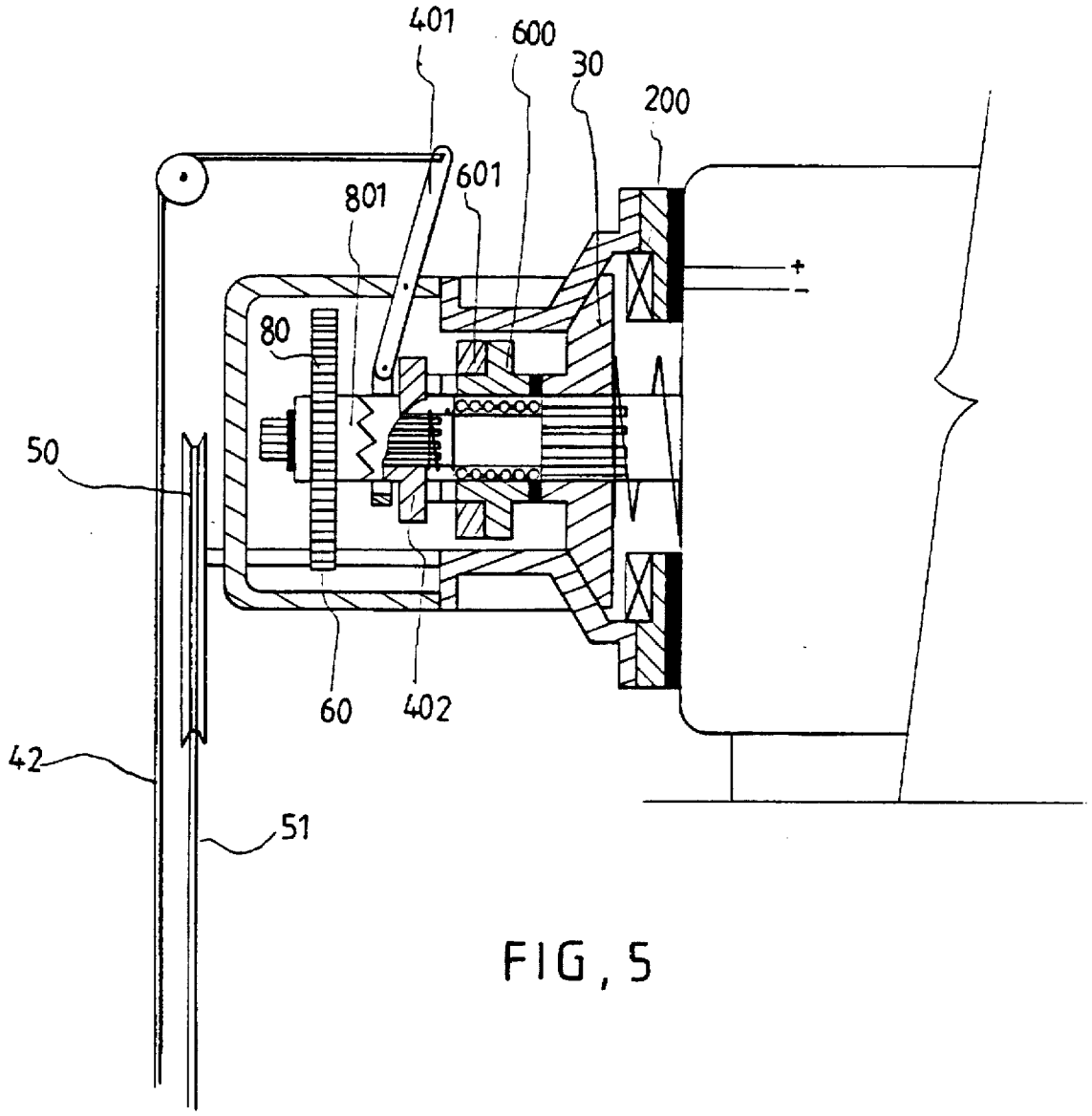
FIG, 5

ELECTOR EMERGENCY DEVICE

FIELD OF THE INVENTION

The present invention relates generally to an elevator, and more particularly to an emergency device of the elevator.

BACKGROUND OF THE INVENTION

The elevator emergency device of the prior art is generally composed of a control room which is provided with a motor transmission spindle brake having an action rod. The action rod is provided horizontally with an applicaion rod having one end capable of swinging and having another end provided with a pull cord. The application rod is provided at the midsegment thereof with a rotary wheel having an action cord winding thereon such that one end of the action cord is fastened with an idle wheel. Located by the rotary wheel is a transmission wheel by which a support rod is located. The transmission wheel is actuated by the rotary wheel. When the pull cord is pulled downwards to cause the application rod to swing downwards so as to enable the transmission wheel to actuate the action wheel, the action rod of the brake is pressed, thereby causing the brake shoe of the brake to become disengaged with the motor transmission spindle. The action wheel is actuated by the transmission wheel. The motor transmission spindle is actuated by the action wheel so as to cause the machinery housed in the speed-changing box to rotate to bring about the action of the lifting and descending cable of the elevator. The motor is a variable speed motor. A worm rod is actuated by a worm wheel so as to bring about the lifting and the descending of the elevator cab. In a high-rise building, the high-speed motor is used. The elevator cab is provided with a heavy weight having a balancing effect. When the pull cord is pulled downwards, the elevator cab is caused to rise or descend rapidly.

SUMMARY OF THE INVENTION

The primary objective of the present invention is to provide an elevator emergency device with a speed-restricting friction wheel having a plurality of friction blocks for regulating the action wheel so as to control the speed at which the elevator lifting and descending cable is at work.

BRIEF DESCRIPTION OF THE DRAWINGS

FIG. 3 shows a side plan schematic view of the present invention at work.

FIG. 4 shows a schematic view of another preferred embodiment of the present invention.

FIG. 5 shows a schematic view of still another preferred embodiment of the present invention.

DETAILED DESCRIPTION OF THE INVENTION

Figure 1:
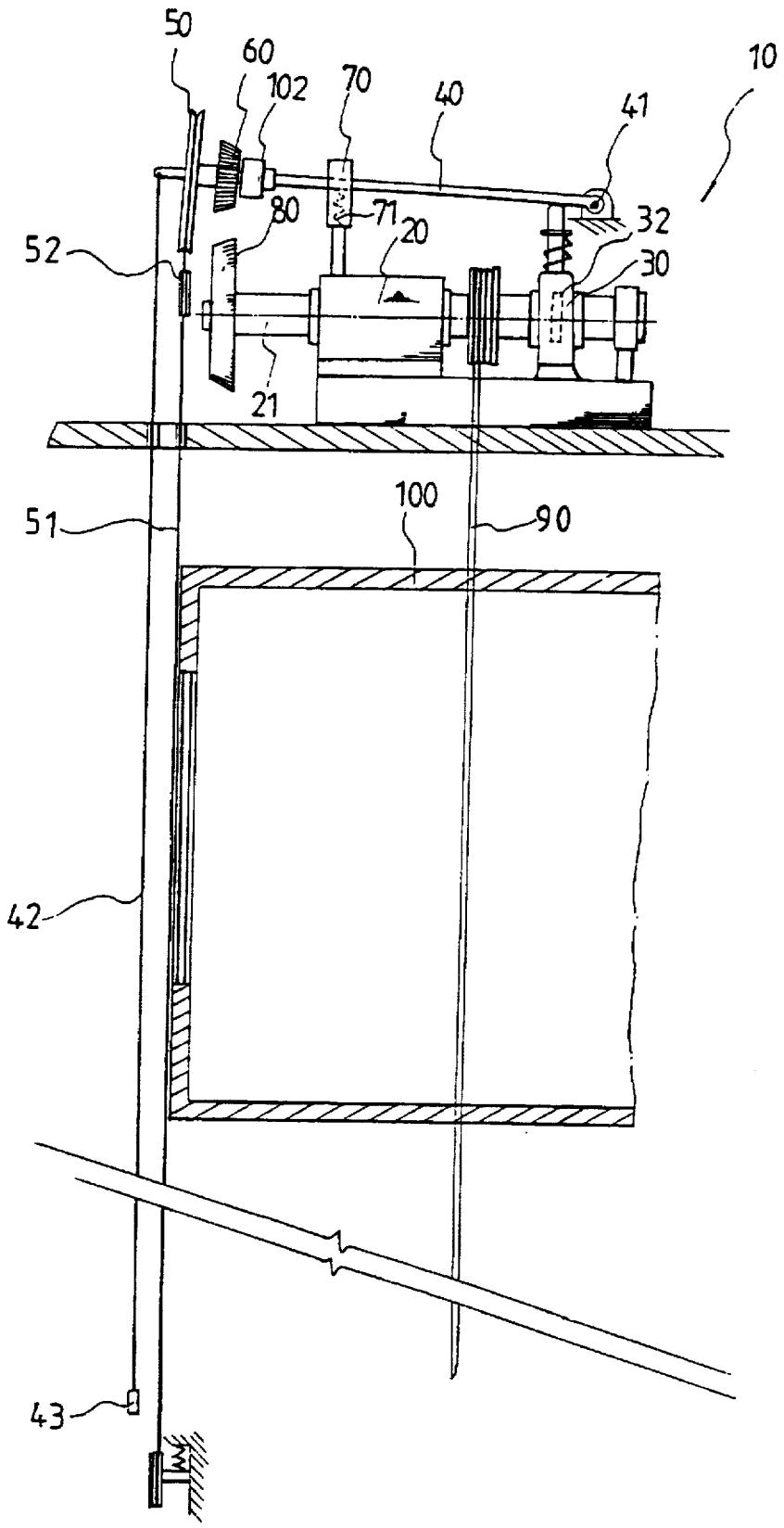
FIG. 1 shows a plan schematic view of the present invention.
Figure 2:
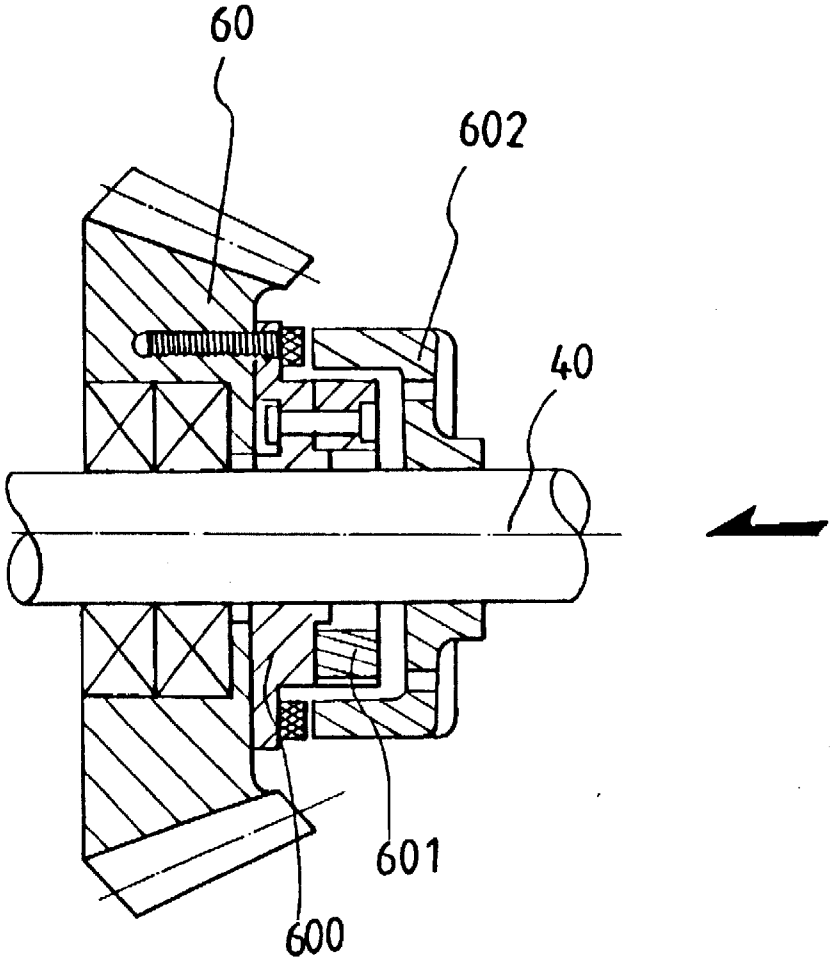
FIG. 2 shows a partial enlarged sectional view of the present invention.

As shown in all drawings provided herewith, an elevator emergency device of the present invention comprises a control room 10 in which a high-speed motor 20 is housed. The motor 20 has a transmission spindle 21. A brake 30 is provided with an action rod 31 which is in turn provided horizontally with an application rod 40 having a radial locating end 41 capable of swinging and further having another end fastened with a pull cable 42 which is in turn fastened at one end thereof with a tension weight 43. The application rod 40 is provided at the midsegment thereof with a rotary wheel 50 having an action cable 51 wound thereon such that one end of the action cable 51 is fastened with an idle wheel 52. Located by the rotary wheel 50 is a transmission wheel 60 by which a support rod 70 is located. The transmission wheel 60 is capable of rotating along with the rotary wheel 50. The pull cable 42 is pulled downwards to bring about the action of the application rod 40. As the application rod 40 is caused to swing downwards, the action wheel 80 is actuated by the transmission wheel 60. Provided at an appropriate location of the transmission wheel 60 and the rotary wheel 50 is a speed-limiting friction wheel 600 which is provided on the radial surface thereof with a plurality of friction blocks 601 pivoted thereto. The speed-limiting friction wheel 600 is covered with a shield cap 602.

As shown in FIG. 3, the action rod 31 of the brake 30 is pressed downwards by the downward swing of the application rod 40 when the pull cable 42 is pulled downwards. In the meantime, the brake shoe 32 is caused to disengage the transmission spindle 21 of the high-speed motor 20. The transmission wheel 60 is caused by the downward swing motion of the application rod 40 to engage the action wheel 80. In the meantime, the action cable 51 is pulled to cause the transmission wheel 60 to actuate the action wheel 80 to rotate, thereby causing the action wheel 80 to actuate the transmission spindle 21 to bring about the operation of the lifting and descending cable 90 to enable the elevator cab 100 to rise or descend. The action cable 51 and the pull cable 42 are pulled with hand by breaking first the acrylic thin plate 111 of the window 110 of the elevator cab 100. As the pull cable 42 is released, the application rod 40 is forced back to its original position by a recovering spring 71 of the support rod 70 in which a circuit breaker is provided to ensure the safety of the elevator emergency device. In view of the weight 101, the elevator cab 100 is capable of generating an inertia acceleration when the elevator cab 100 is rising or descending. As a result, the friction blocks 601 of the friction wheel 600 of the transmission wheel 60 is caused by the centrifugal force to move outwards when the rapid displacement of the elevator cab 100 is under way, thereby causing the friction blocks 601 to make contact with the shield cap 602 for preventing the action wheel 80 from turning rapidly. The friction blocks 601 are provided therebetween with a tension spring 601 capable of adjusting the friction blocks 601 for regulating the friction wheel 60 such that the friction wheel 60 must rotate faster than a predetermined speed so as to actuate the lifting and descending cable 90.

Another preferred embodiment of the present invention is provided with the brake 30 which is mounted on the transmission spindle 211 of the motor 20. When the motor 20 is operating at a high speed, an action device 200 is at work to prevent the brake 30 from generating the friction resistance. When an incident takes place, the swing rod 401 can be actuated by pulling the pull cable 42 so as to enable the clutch 402 to join with the friction wheel 600 for causing the brake 30 to retreat. As a result, the elevator cab 100 can be caused to rise or descend by means of the weight and by actuating the action cable 51 to cause the rotary wheel 50 to actuate the transmission wheel 60 to turn. In the meantime, the action wheel 80 is caused to turn so as to cause a ratchet 801 to push radially the clutch 402 to join with the friction wheel 600 by means of which the brake 30 is retreated, thereby enabling the elevator cab 100 to be lifted or descended by pulling the action cable 51 to cause the rotary wheel 50 to rotate forward or backward.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An elevator emergency device comprising a motor spindle brake having an action rod which is provided horizontally with an application rod having one end capable of being caused to swing, said application rod further having another end provided with an action cable, said application rod provided at a midsegment thereof with a rotary wheel which is provided with an action cable wound thereon such that one end of said action cable is fastened with an idle wheel, said device further comprising a support rod located by a transmission wheel capable of being actuated by said rotary wheel, said application rod capable of being caused to swing by pulling a pull cable so as to actuate said action wheel to turn, thereby causing a brake shoe of said brake to disengage said motor transmission spindle so as to enable said action wheel to be actuated by said transmission wheel, said motor transmission spindle capable of being actuated by said action wheel so as to activate an elevator cab lifting and descending cable; wherein said transmission wheel and said rotary wheel are provided with a speed-limiting friction wheel having radially a plurality of friction blocks pivoted thereto for regulating the rotational speed of said action wheel.

2. The device as defined in claim 1, wherein said brake is mounted on one end of said motor transmission spindle such that said brake is caught by an action device when said motor is operated at a high speed so as to enable a swing rod to be actuated by said pull cable such that a clutch and said friction wheel are caused by said swing rod to join together to enable said brake to be pushed away for allowing said elevator cab to be lifted or descended by a weight, said transmission wheel capable of being actuated by said rotary wheel, said action wheel provided with a ratchet capable of pushing radially said clutch to join with said friction wheel so as to push away said brake in order to enable said action cable to be operated manually in case of emergency.

* * * * *